US011448017B2

(12) United States Patent
Cree et al.

(10) Patent No.: US 11,448,017 B2
(45) Date of Patent: Sep. 20, 2022

(54) COMPENSATED ELEVATOR LINK

(71) Applicant: AME Pty Ltd, Perth (AU)

(72) Inventors: David Cree, Perth (AU); Jonathan Wright, Perth (AU); Kayne Semmens, Perth (AU)

(73) Assignee: AME Pty Ltd, Perth (AU)

( * ) Notice: Subject to any disclaimer, the term of this patent is extended or adjusted under 35 U.S.C. 154(b) by 213 days.

(21) Appl. No.: 16/687,821

(22) Filed: Nov. 19, 2019

(65) Prior Publication Data

US 2020/0224505 A1 Jul. 16, 2020

Related U.S. Application Data

(63) Continuation of application No. PCT/AU2018/050481, filed on May 19, 2018.

(51) Int. Cl.

| | |
|---|---|
| ***E21B 19/00*** | (2006.01) |
| ***E21B 19/09*** | (2006.01) |
| ***B66C 13/10*** | (2006.01) |

(52) U.S. Cl.

CPC ..... *E21B 19/006* (2013.01); *B66C 13/10* (2013.01); *E21B 19/09* (2013.01)

(58) Field of Classification Search

CPC ..... E21B 19/006; E21B 19/09; B66C 13/10
See application file for complete search history.

(56) References Cited

U.S. PATENT DOCUMENTS

| | | | | |
|---|---|---|---|---|
| 3,912,227 A * | 10/1975 | Meeker | ..... | E21B 19/09 254/271 |
| 4,004,532 A | 1/1977 | Reynolds | | |
| 5,252,004 A * | 10/1993 | Butler | ..... | E21B 19/09 405/211 |

(Continued)

FOREIGN PATENT DOCUMENTS

| | | |
|---|---|---|
| GB | 545906 | 6/1942 |
| GB | 2144198 | 2/1985 |
| WO | WO 2018/209407 | 11/2018 |

OTHER PUBLICATIONS

International Search Report and the Written Opinion dated Aug. 29, 2018 From the International Searching Authority Re. Application No. PCT/AU2018/050481. (15 Pages).

(Continued)

*Primary Examiner* — Matthew R Buck

(57) ABSTRACT

A compensated elevator link is disclosed. In at least one aspect, the compensated elevator link comprises a plurality of cylinder housings and a rod having a plurality of ends, each end comprising a piston head adapted to be slideably received within one of the cylinder housings for defining first and second hydraulic cylinders. Each hydraulic cylinder has at least one annulus for receiving a non-compressible fluid. The rod comprises a passage for receiving a compressible fluid, wherein each piston head comprises at least one passage to allow selective displacement of the non-compressible fluid between the annulus of the cylinder housing and the passage within the rod during selective displacement of the hydraulic cylinders between a contracted condition to an extended condition for either compression or expansion of the compressible fluid by the non-compressible fluid.

20 Claims, 13 Drawing Sheets

(56) References Cited

U.S. PATENT DOCUMENTS

| | | | | |
|---|---|---|---|---|
| 5,846,028 | A * | 12/1998 | Thory | E21B 19/006 405/195.1 |
| 9,284,797 | B2 * | 3/2016 | Skinnes | E21B 19/006 |
| 9,422,791 | B2 * | 8/2016 | Plain | E21B 19/09 |
| 2005/0074296 | A1 * | 4/2005 | McCarty | E21B 19/006 405/224.4 |
| 2005/0077049 | A1 * | 4/2005 | Moe | E21B 19/006 166/355 |
| 2014/0238685 | A1 | 8/2014 | Ottersland | |
| 2015/0184470 | A1 * | 7/2015 | Megens | E21B 19/006 166/355 |
| 2017/0009537 | A1 | 1/2017 | Poehner | |

OTHER PUBLICATIONS

Examination Report dated Nov. 29, 2019 From the Australian Government, IP Australia Re. Application No. 2019216729. (8 Pages).

* cited by examiner

COMPENSATED ELEVATOR LINK

RELATED APPLICATIONS

This application is a Continuation of PCT Patent Application No. PCT/AU2018/050481 having International filing date of May 19, 2018, which claims the benefit of priority of Australian Patent Application No. 2017901910 filed on May 19, 2017. The contents of the above applications are all incorporated by reference as if fully set forth herein in their entirety.

FIELD AND BACKGROUND OF THE INVENTION

A compensated elevator link for use on a floating vessel such as a mobile offshore drilling unit (drill ship or a drill rig) or a workover or production vessel.

The compensated elevator link provides compensation for overtension, undertension (or both) of a drill string, riser, completion string or landing string in the event that the vessel's primary compensation system is disabled or is inoperative. The system may be used as an inline compensator, a primary compensation system, or a back-up compensation system.

The following discussion of the background art is intended to facilitate an understanding of the present invention only. The discussion is not an acknowledgement or admission that any of the material referred to is or was part of the common general knowledge as at the priority date of the application.

When drilling operations are conducted from a floating vessel, the vessel will roll, pitch, and heave in response to the ocean's seastate, potentially creating unwanted motion in the drill string or riser, and impacting on the efficiency and safety of the drilling operation. The effect of roll and pitch on the drilling operation can be minimised by locating the drilling derrick at the centre of the vessel roll and pitch centre; however, the heave of the floating vessel presents a unique problem that can only be managed through the introduction of mechanical motion compensation systems that ideally generate equal and opposite motion to the heaving vessel.

Drill ships or floating drilling rigs (hereinafter referred to as drilling rigs) therefore incorporate active or passive compensation systems that are mounted in the derrick to account for the heave and allow for ongoing operations in a range of sea states. The purpose of the compensator system is to generate an equal and opposite motion to the drilling rig's heave motion to ensure that weight on the drill bit is maintained, whilst preventing excessive compression in the drill string or riser.

Passive heave compensation systems utilise hydraulic cylinders with pneumatic accumulators. The accumulators provide a spring force to the hydraulic piston, driving the compensating cylinder either in or out in response to changes in accumulator pressure that results from changes in string tension. The accumulators are often large in size and mounted in a static location with a pneumatic connection between the accumulator bank and the hydraulic cylinder(s).

Active heave compensation systems utilise electronic systems to drive the rig's travelling block in an equal and opposite direction to the heaving vessel. Active heave compensation systems are more complex than passive compensators, but have the advantage of maintaining lower load variations than their passive counterparts.

In specific offshore activities such as well testing, workovers, well intervention or completion operations there is an operational requirement to create a "locked to bottom" scenario, whereby the rig's drilling system is physically connected via various types of interface equipment, to the riser/completions string/landing string/workover riser or other tied to bottom strings and risers (hereinafter referred to as the workstring).

During these activities, the rig's primary heave compensation system must perform without incident to prevent the ongoing heave motion of the rig from developing excessive forces in the workstring.

If during a locked to bottom scenario, the rig's primary heave compensation system fails, the rig will continue to heave up and down and subject the workstring to potentially excessive tensile or compressive forces. This may then result in the failure of the workstring, creating damage to equipment and producing significant safety risks for personnel and the environment.

There is therefore a requirement to develop a system that will preferentially extend and retract; thereby compensating for the heave motion of the drilling rig in the event that the primary heave compensation system is disabled or becomes inoperable.

Existing in the art, there is an example of a telescopic elevator link that may be used during locked to bottom operations. The telescopic elevator link extends the functionality of the common industry standard elevator link by introducing a sleeved, telescopic arrangement and a shear pin. The shear pin will preferentially fail in the event of an overtension in the drilling system. The system is easily installed into the derrick due to its familiar elevator link form. However, once the system has activated, all tension in the drill string is lost and the shear pin cannot be reset without rigging down the drill floor equipment.

In other examples existing within the art, there are passive compensation systems that may be used as either primary rig compensation systems or back-up systems, that may be rigged up either in-line or in parallel to the equipment used during locked to bottom operations. These systems are typically large in size and mass and often utilise complicated valve systems in their operation. Because of the complexity, size, and mass of these systems, they are costly to install onto the drilling vessel due to their requirements for transport, mobilisation, and installation onto the drilling vessel.

There is therefore a requirement to provide a system that is simple to handle on the drill floor and is easily installed into the drilling derrick; and also combines a passive compensation ability that requires little or no intervention to activate or reset in the event that the system is used to compensate for rig heave during a locked to bottom scenario.

It is against this background that the present invention has been developed.

SUMMARY OF THE INVENTION

According to a first aspect of the invention there is provided an elevator link arranged for use in providing a compensatory response to a load applied thereto, the elevator link comprising:

first and second actuable means configured operable with a piston rod by way of respective first working fluids, the piston rod having an internal chamber for accommodating a second working fluid, the first and second actuable means arranged in operable association with the piston rod such that the first and second working fluids are cooperable with each other so as to allow the elevator link to be operable toward and/or from one of an extended condition and a retracted condition in response to the load.

According to a second aspect of the invention there is provided an elevator link arranged for use in providing a compensatory response to a load applied thereto, the elevator link comprising:

first and second actuable device configured operable with a piston rod by way of respective first working fluids, the piston rod having an internal chamber for accommodating a second working fluid, the first and second actuable device arranged in operable association with the piston rod such that the first and second working fluids are cooperable with each other so as to allow the elevator link to be operable toward and/or from one of an extended condition and a retracted condition in response to the load.

Preferably, each actuable means or device is provided in the form of a hydraulic cylinder having a cylindrical housing.

Preferably, opposite free ends of the piston rod are slideably associated with a respective cylinder housing. In one embodiment, the free ends of the piston rod comprise or are connected to respective piston heads.

Preferably, the first working fluid is a non-compressible fluid, such as for example, a hydraulic oil.

Preferably, the second working fluid is a compressible fluid, such as for example, a gas.

Preferably, in the context where the elevator link is arranged operable for 'in-line' use in a drilling operation, the elevator link may be configured to provide one or more of the following responses: tension compensation, compression compensation, and tension and compression compensation.

According to a third aspect of the invention there is provided a compensated elevator link comprising a plurality of cylinder housings and a rod having a plurality of ends, each end comprising a piston head adapted to be slideably received within one of the cylinder housings for defining first and second hydraulic cylinders, each hydraulic cylinder having at least one annulus for receiving a non-compressible fluid and the rod comprising a passage for receiving a compressible fluid; wherein each piston head comprises at least one passage to allow selective displacement of the non-compressible fluid between the annulus of the cylinder housing and the passage within the rod during selective displacement of the hydraulic cylinders between a contracted condition to an extended condition for either compression or expansion of the compressible fluid by the non-compressible fluid.

Preferably, the first hydraulic cylinder is pressurised with a particular pneumatic pressure that results in the first hydraulic cylinder retracting when a particular threshold pressure is reached due to a particular tensional force that is being applied to the compensated elevator link.

Preferably, for the case where said tensional force is being applied by way of a workstring of a drilling rig, the particular threshold pressure is reached due to an under-tension in the workstring.

Preferably, the second hydraulic cylinder is pressurised with sufficient pneumatic pressure to prevent the second hydraulic cylinder from extending until a particular threshold pressure is reached due to a particular tensional force that is being applied to the compensated elevator link.

Preferably, for the case where said tensional force is being applied by way of a workstring of a drilling rig, the particular threshold pressure is reached due to an over-tension in the workstring.

Preferably, each piston head when contained in a cylinder housing defines a plurality of spaces in the cylinder housing.

Preferably, a first space is defined between the piston head and the end of the cylinder housing.

Preferably, the first space comprises a vacuum or a compressible fluid at low pressure.

Preferably, a second space is defined between an entry point of the cylinder housing and the piston head.

Preferably, the second space defines the annulus including the non-compressible fluid.

Preferably, the annulus of each hydraulic cylinder is defined between the inner walls of the cylinder housing and the outer walls of the rod.

Preferably, each piston head comprises a plurality of fluid paths fluidly connecting the annulus, of the respective hydraulic cylinder, and the passage of the rod.

Preferably, each of the fluid paths comprises valves means for controlling flow of the non-compressible fluid between the annulus and the passage of the rod.

Preferably, each fluid path comprises a valve adapted to control fluid flow.

Preferably, the valve allows fluid flow in one direction and in the other direction, controlling the amount of non-compressible fluid that may flow though the flow path.

Preferably, the valves are adapted to control the flow of non-compressible fluid from the passage of the rod into the annulus; in this particular arrangement, controlling the non-compressible fluid flow from the passage into the annulus permits controlling recoil of the compensated elevator link after removal of the tensional forces.

Preferably, the compressible fluid defines a compressible fluid spring within the passage of the rod for applying a pressure to the non-compressible fluid entering the rod permitting the compensated elevator link to return to the retracted condition after the tensioning force is no longer applied to the compensated elevator link.

Preferably, the compensated elevator link comprises means for containment of the compressible fluid stored in the passage of the rod within a particular location of the passage.

Preferably, the means for containment of the compressible fluid comprises a plurality of containment pistons arranged in a spaced apart relationship with respect to each other.

Preferably, the containment pistons are adapted to define a seal between side walls of the containment pistons and the inner walls of the rod.

Preferably, the containment pistons are adapted to slide within the passage of the rod.

Preferably, the first and second hydraulic cylinders are fluidly connected to the passage of the rod such that the pressure applied to the non-compressible fluid of the first and second hydraulic cylinder is the same.

Preferably, the first and second hydraulic cylinders are responsive such that the pressure applied to the non-compressible fluid of the first and second hydraulic cylinder is the same.

Preferably the rod comprises an orifice plate having an orifice permitting fluid communication between sections of the passage of the rod.

In an alternative arrangement, the orifice place comprises a blanking plate for closing of the orifice place to divide the passage of the rod into two separate sub-passages, one sub-passage being fluidly connected to the first hydraulic cylinder and the other sub-passage being fluidly connected to the first hydraulic cylinder permitting operating the first and hydraulic cylinders at different pressures with respect to each other.

Preferably, each cylinder housing comprises a first end and a second end, the first end being adapted for receiving a cap for closing of the first end, and the second end adapted to receive a respective the piston head coupled to the piston rod.

Preferably, the first end of each cylinder housing comprises access fill ports.

Preferably, the caps are bolted to the cylinder housing including appropriate sealing means to define hermetic junctures between the bolts and the ends of the housing.

Preferably, the compensated elevator link comprises a plurality of bail ends comprising bail eyes attached to the caps of each hydraulic cylinder.

Preferably, the bail eyes are forged bail ends having a threaded end to be mechanically connected to the caps comprising an opening having an inner thread for receiving the threaded end of the forged bail.

Preferably, the forged bail ends are forged from a single piece of metal.

In a particular arrangement, the compensated elevator link is adapted to be fluidly connected to another compensated elevator link in accordance with the first aspect of the invention.

In a particular arrangement, the compensated elevator link(s) comprise(s) ports for fluidly connecting the compensated elevator link to the another compensated elevator link.

In a particular arrangement, the housing of each hydraulic cylinder of the compensated elevator link and the another compensated elevator link comprises a port for connection of tubing to join the hydraulic cylinders.

Preferably, the compensated elevator link comprises one or more sensors for measurement of temperature and/or pressure of the hydraulic and compressible fluids contained in the hydraulic cylinders and passage of the rod.

In an arrangement, the sensors comprise wireless sensors.

Preferably, one or both hydraulic cylinders comprise locking means for impeding extension of the hydraulic cylinders Preferably, the second hydraulic cylinder comprises locking means for impeding extension of the second hydraulic cylinder.

Preferably, each hydraulic cylinder comprise means for impeding the piston head from impacting the ends of the cylinder housing.

According to a fourth aspect of the invention there is provided a compensation system for compensating heave motion of a floating drilling rig comprising a derrick, and a workstring operatively attached to a main hoist attached to the derrick, the system comprising a compensation unit attached between the main hoist and the workstring, the compensation unit comprising one or more elevator links arranged in accordance with the first or second aspects (or as described herein) or one or more compensated elevator links arranged in accordance with the third aspect of the invention or as described herein.

According to a fifth aspect of the invention there is provided a compensation unit for attachment between a main hoist and a workstring of a drilling rig, the compensation unit comprising first and second spreader beams and a plurality of compensated elevator links arranged in a spaced apart arrangement with respect to each other, each compensated elevator link having an end attached to the first spreader beam and another end attached to the second spreader beam, wherein each compensated elevator link is an elevator link arranged according to the first or second aspects (or as described herein) or a compensated elevator arranged according to the third aspect of the invention or as described herein.

Preferably, the upper and lower spreader beams comprises means for attaching the bail eyes of the compensated elevator links.

Preferably, each means for attaching the bail eye comprises a lug for receiving the bail eye.

Preferably, each of the spreader beams comprises a pair of lugs spaced apart with respect to each other so that the compensated elevator links are arranged in a spaced apart relationship with respect to each other.

Preferably, the compensation unit is attached between a top drive and the workstring of the drilling rig.

Preferably, the first hydraulic cylinder is pressurised with a particular pneumatic pressure that results in the first hydraulic cylinder retracting when a particular threshold pressure is reached due to a particular tensional force that is being applied to the compensated elevator link.

Preferably, the particular threshold pressure is reached due to an under-tension in the workstring.

Preferably, the second hydraulic cylinder is pressurised with sufficient pneumatic pressure to prevent the second hydraulic cylinder from extending until a particular threshold pressure is reached due to a particular tensional force that is being applied to the compensated elevator link.

Preferably, the particular threshold pressure is reached due to an over-tension in the workstring.

According to a sixth aspect of the invention there is provided a compensation system for compensating heave motion of a floating drilling rig comprising a derrick and a workstring operatively attached to a main hoist attached to the derrick, the system comprising an elevator link arranged according to the first or second aspects (or as described herein) or a compensation unit as defined in the fifth aspect of the invention or as described herein.

According to a seventh aspect of the invention there is provided an in-line compensator for compensating heave motion of a floating drilling rig comprising a derrick and a workstring operatively attached to a main hoist attached to the derrick, the in-line compensator comprising an elevator link arranged according to the first or second aspects (or as described herein) or a compensated elevator link arranged according to a third aspect of the invention (or as described herein) and means for attaching the elevator link or the compensated elevator link between the main hoist and the workstring.

According to an eighth aspect of the invention there is provided a compensated elevator link comprising a cylinder housing and a rod having an end comprising a piston head adapted to be slideably received within the cylinder housing for defining a hydraulic cylinder having an annulus for receiving a non-compressible fluid and the rod comprising a passage for receiving a compressible fluid; wherein the piston head comprises at least one passage to allow selective displacement of the non-compressible fluid between the annulus of the cylinder housings and the passage within the rod during selective displacement of the hydraulic cylinders between a contracted condition to an extended condition for either compression or expansion of the compressible fluid by the non-compressible fluid.

According to a ninth aspect of the invention there is provided a method of providing back-up compensation to a drilling rig mounted on a vessel or semi-submersible rig comprising a primary rig compensation unit, and a derrick and a workstring operatively attached to a main hoist attached to the derrick in instances where the primary rig compensation unit fails, the method comprising the steps of:

connecting one or more elevator links arranged according to the first or second aspects (or as described herein) or one or more compensated elevator links arranged according to the third aspect of the invention (or as described herein) between the main hoist and the workstring;

pressurising the first hydraulic cylinder with a particular pneumatic pressure that results in the first hydraulic cylinder retracting when a particular threshold pressure is reached due to a particular tensional force being applied to the or each elevator link or the or each compensated elevator link; and pressurising the second hydraulic cylinder with sufficient pneumatic pressure to prevent the second hydraulic cylinder from extending until a particular threshold pressure is reached due to a particular tensional force being applied to the or each elevator link or the or each compensated elevator link.

Preferably, the elevator link(s)/compensated elevator link (s) is/are adapted to activate after failure of the primary rig compensation unit fails.

Preferably, the elevator link(s)/compensated elevator link (s) is(are) adapted to maintain static condition during proper functioning of the primary rig compensation unit, wherein the elevator link(s)/compensated elevator link(s) maintain the static condition by being pressurised such that the hydraulic cylinders of the elevator link(s)/compensated elevator link(s) are impeded from extending or retracting when tensional forces of particular magnitude are being applied to the elevator link(s)/compensated elevator link(s).

According to a tenth aspect of the invention there is provided a compensated elevator link comprising a cylinder housings and a rod having an end comprising a piston head adapted to be slideably received within the cylinder housings for defining hydraulic cylinder having an annulus for receiving a non-compressible fluid and the rod comprising a passage for receiving a compressible fluid; wherein the piston head comprises at least one passage to allow selective displacement of the non-compressible fluid between the annulus of the cylinder housings and the passage within the rod during selective displacement of the hydraulic cylinders between the contracted condition to the extended condition.

In one arrangement, the hydraulic cylinder is pressurised with a particular pneumatic pressure that results in the hydraulic cylinder retracting when a particular threshold pressure is reached due to a particular tensional force that is being applied to the compensated elevator link.

Preferably, the particular threshold pressure is reached due to an under-tension in the workstring In an alternative arrangement, the hydraulic cylinder is pressurised with sufficient pneumatic pressure to prevent the hydraulic cylinders from extending until a particular threshold pressure is reached due to a particular tensional force that is being applied to the compensated elevator link.

Preferably, the particular threshold pressure is reached due to an over-tension in the workstring.

According to an eleventh aspect of the invention there is provided a self-contained passively compensated elevator link, the upper end of the compensator elevator link connects through various types of interface equipment, to the rig/vessel string hoisting system, primary compensator or vessel structure, from herein referred to as the derrick and the lower end of the compensator elevator link connects through various types of interface equipment, to the riser/completions string/landing string/workover riser or other tied to bottom strings & risers, from herein referred to as the workstring.

Preferably, the self-contained compensator elevator link may be configured in various manners to provide tension compensation, compression compensation or tension and compression compensation.

Preferably, the compensator elevator link utilise common industry standard elevator link connections to ensure the equipment easily interfaces with other drill floor equipment.

According to a twelfth aspect of the invention there is provided an elevator link arranged for use in providing a compensatory response to a load applied thereto, the elevator link comprising:

an actuable means configured operable with a piston rod by way of a first working fluid, the piston rod having an internal chamber for accommodating a second working fluid, the actuable means arranged in operable association with the piston rod such that the first and second working fluids are cooperable with each other so as to allow the elevator link to be operable toward and/or from one of an extended condition and a retracted condition in response to the load.

According to a thirteenth aspect of the invention there is provided an elevator link arranged for use in providing a compensatory response to a load applied thereto, the elevator link comprising:

an actuable device configured operable with a piston rod by way of a first working fluid, the piston rod having an internal chamber for accommodating a second working fluid, the actuable device arranged in operable association with the piston rod such that the first and second working fluids are cooperable with each other so as to allow the elevator link to be operable toward and/or from one of an extended condition and a retracted condition in response to the load.

According to a fourteenth aspect, there is provided an elevator link arranged for use in providing a compensating response to a load applied between load points of the elevator link, the elevator link comprising:

a first actuable device associated with one of the load points;

a second actuable device associated with another of the load points; and a piston rod connecting a respective piston of each actuable device;

wherein the first and second actuable devices each comprise a respective hydraulic cylinder for receiving the respective piston;

wherein movement of each piston within the respective hydraulic cylinder is according to an amount of a respective non-compressible first working fluid in the respective hydraulic cylinder;

wherein the piston rod comprises an internal chamber for accommodating a compressible second working fluid, wherein the first and second working fluids cooperate to determine the amount of respective first working fluid in each respective hydraulic cylinder so as to allow the elevator link to extend or retract between the load points in response to the load.

Embodiments of the elevator link of the fourteenth aspect may incorporate any of the features of the elevator link or the compensated elevator as described herein.

Various principal aspects described herein can be practiced alone or in combination with one or more of the other principal aspects, as will be readily appreciated by those skilled in the relevant art. The various principal aspects can optionally be provided in combination with one or more of the optional features described in relation to the other principal aspects. Furthermore, optional features described in relation to one example (or embodiment) can optionally be combined alone or together with other features in different examples or embodiments.

For the purposes of summarising the principal aspects, certain aspects, advantages and novel features have been described herein above. It is to be understood, however, that not necessarily all such advantages may be achieved in accordance with any particular embodiment or carried out in a manner that achieves or optimises one advantage or group of advantages as taught herein without necessarily achieving other advantages as may be taught or suggested herein.

BRIEF DESCRIPTION OF THE SEVERAL VIEWS OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

Figure 1A:
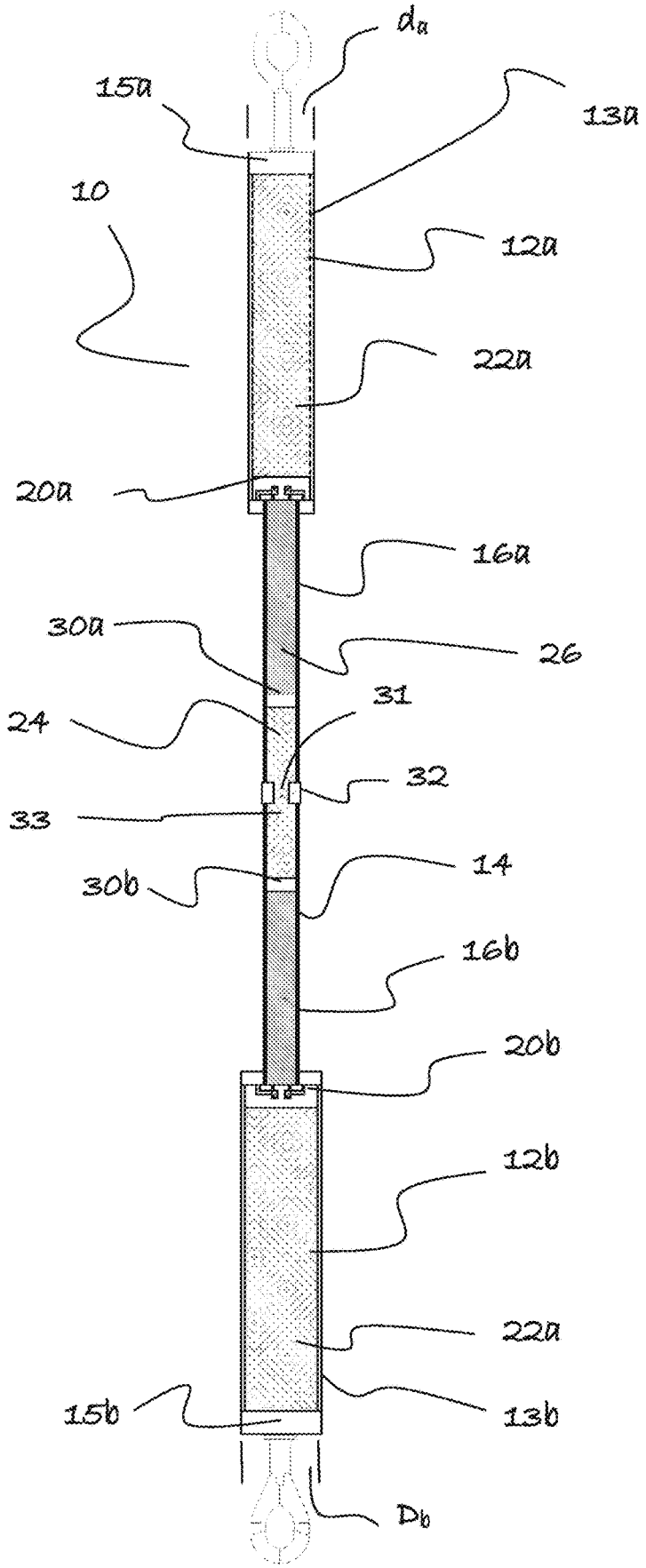
FIG. 1*a* shows a cross-sectional view of a particular arrangement of a compensated elevator link in accordance with an embodiment of the invention (shown in an extended condition.

It should be noted that the figures are schematic only and the location and disposition of the components can vary according to the particular arrangements of the embodiments of the present invention as well as of the particular applications of the present invention.

DESCRIPTION OF SPECIFIC EMBODIMENTS OF THE INVENTION

FIGS. 1*a* to 1*d* show a particular arrangement of a compensated elevator link 10 in accordance with an embodiment of the invention.

The compensated elevator link 10 comprises a first hydraulic cylinder 12*a* and a second hydraulic cylinder 12*b* (collectively, hydraulic cylinder(s) 12) and a rod 14. Each hydraulic cylinder 12 comprises a respective cylinder housing 13*a*, 13*b* (collectively, cylinder housing(s) 13). Both cylinder housings 13 are slideably attached to the rod 14 permitting the compensated elevator link 10 to be selectively displaced between an extended condition (see FIG. 1*a*), a semi-extended condition (see FIG. 1*b*) and a contracted condition (see FIG. 1*c*).

The rod 14 comprises a first outer section 16*a* and a second outer section 16*b* (collectively, outer section(s) 16); each outer section 16 of the rod 14 is adapted to be slideably received within one of the hydraulic cylinders 12.

Figure 1B:
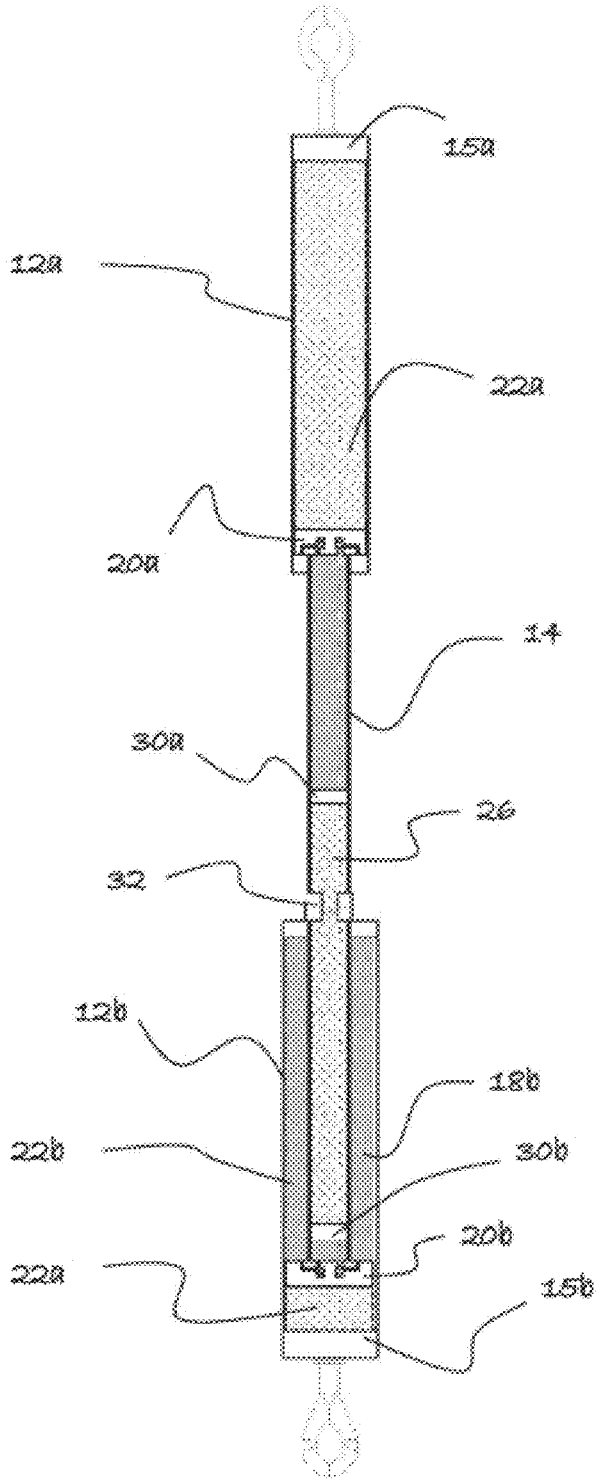
FIG. 1*b* shows a cross-sectional view of the compensated elevator link shown in FIG. 1*a* (shown in a semi-extended condition)
Figure 1C:
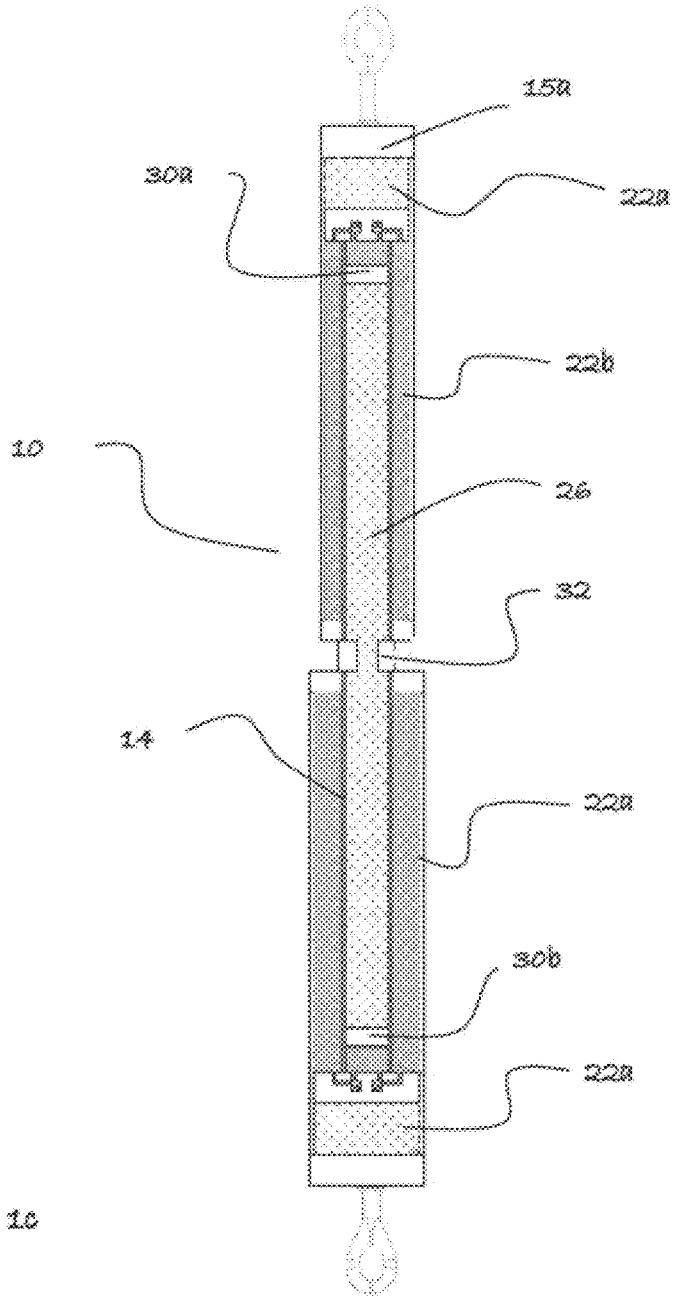
FIG. 1*c* shows a cross-sectional view of the compensated elevator link shown in FIG. 1*a* (shown in a contracted condition)
Figure 1D:
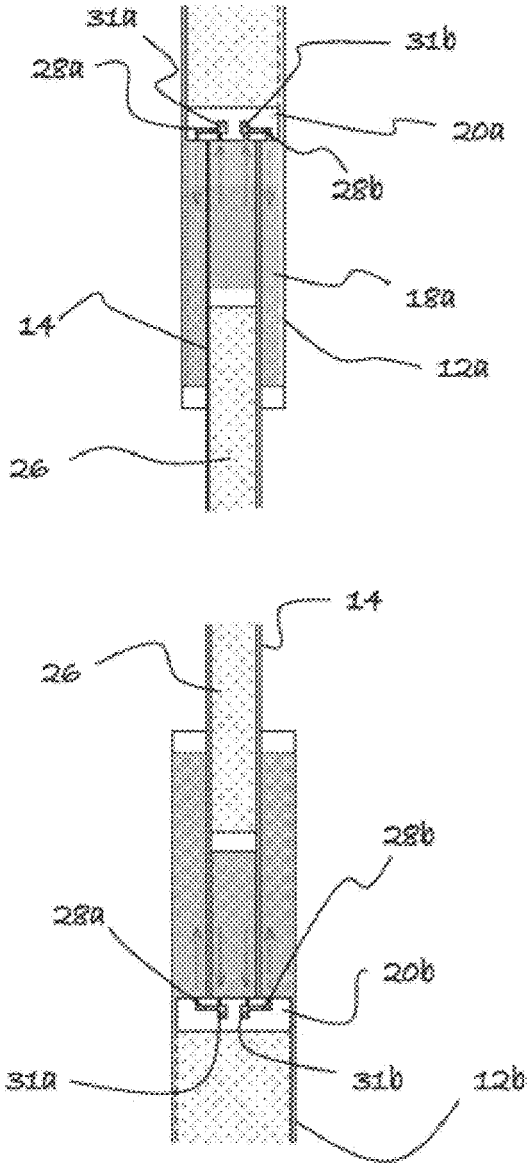
FIG. 1*d* shows a detail of the cross-sectional view of the upper and lower portions of the embodiment of the compensated elevator link shown in FIGS. 1*a* to 1*d;*

As shown in FIGS. 1*b* to 1*d*, when the outer sections 16 of the rod 14 are inserted in the cylinders 12, annuluses 18*a* and 18*b* (collectively, annuluses 18) are defined within respective cylinder housings 13; in particular, the annuluses 18 are defined between the inner walls of the cylinder housings 13 and the outer walls of the rod 14. The annuluses 18 are adapted to receive a non-compressible fluid such as, for example, oil.

Further, each end of the rod 14 comprises a respective piston head 20*a*, 20*b* (collectively, piston head(s) 20) located at the end of each outer section 16 of the rod 14. The piston heads 20 separate the internal space of the cylinder housings 13 into two separate spaces 22*a* and 22*b*. Movement of each cylinder housing 13 will vary the volume of the spaces 22*a* and 22*b* (collectively, spaces 22). Indeed, each piston head 20*a*, 20*b* may be selectively displaced within the cylinder housings 13 by moving the cylinder housings themselves.

By moving the cylinder housings 13, the volumes of spaces 22 are varied due to movement of piston heads 20 within the cylinder housings 13 as can be appreciated upon comparison of, for example, FIG. 1*a* and FIG. 1*c*.

Space 22*b* defined in each annulus 18 of the hydraulic cylinders 12 is adapted to receive a non-compressible fluid (such as, for example, a hydraulic oil) and space 22*a* may comprise a vacuum, or may include a compressible fluid (for example, a pneumatic fluid or a gas such as nitrogen); in the particular arrangement where the space 22*a* includes a compressible fluid, a low pressure cushion of compressible fluid is defined within the space 22*a*.

Furthermore, the rod 14 comprises a space 24 for containment of the compressible fluid (such as nitrogen). Due to the rod incorporating the space 24 for containment of the compressible fluid; the rod 14 acts as an accumulator for storing the compressible fluid (for example a compressible fluid such as nitrogen gas). This permits the rod 14 to act as a pressure storage reservoir during extension of the compensated elevator link 10 (while the tensional forces are applied to the compensated elevator link 10) and that upon loss of the tensional forces the pressure is released to return the compensated elevator link 10 to the retracted condition. In this manner, the compensated elevator link 10 is a self-contained passive compensator elevator link due to having incorporating the accumulator within the compensated elevator link 10.

Figure 9:
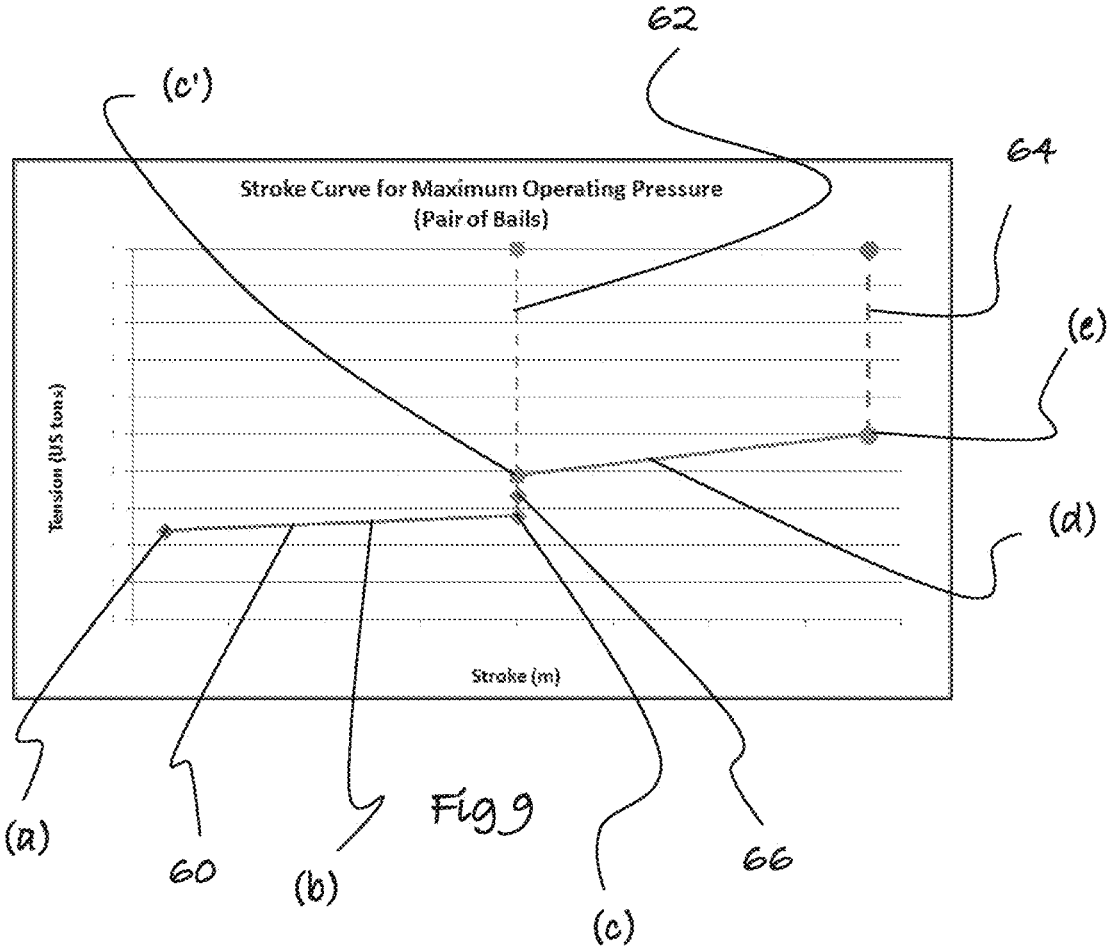
FIG. 9 shows a stroke curve for maximum operation pressure for the compensation unit shown in FIG. 4.

Further, the advantage that the rod 14 contains a compressible fluid such as a gas is that by having a compressible fluid in the rod 14, the variation in tension during extension of either the first 12*a* or second 12*b* hydraulic cylinder (represented by the line between point (a) to (c) and the line between point (c') to point (e) depicted in the graph shown in FIG. 9) is smaller than when compared to a particular arrangement of elevator link 10 where the rod 14 would contain a non-compressible fluid.

In the particular arrangement shown in the Figures, the rod 14 comprises a cylindrical body having a passage 26 (defining the space 24) extending from one end of the rod 14 to the opposite end of the rod 14 to permit selective displacement of the hydraulic fluid between the hydraulic cylinders 12 and the passage 26 of the rod 14.

The flow of the hydraulic fluid between the hydraulic cylinders 12 and the passage 26 of the rod 14 is conducted through the piston heads 20 of the hydraulic cylinders 12; for this the piston heads 20 comprise fluid paths 28 permitting flow of the hydraulic fluid through the pistons 20.

Referring in particular to FIG. 1*d*, each piston head 20 comprises a plurality of fluid paths 28 (paths 28*a*, 28*b* shown) fluidly connecting the annulus 18, of the respective hydraulic cylinder 12, and the passage 26 of the rod 14.

Each of the fluid paths 28*a*, 28*b* comprises valve means for controlling flow of the hydraulic fluid between the annulus 18 and the passage 26. In a particular, application of the present compensated elevator link to be described later, each fluid path 28 comprises a respective valve 31 (valves 31*a*, 31*b* shown in FIG. 1*d*) adapted to control fluid flow; in particular, the valve 31 allows free fluid flow in one direction and in the other direction the valve 31 controls the amount of hydraulic fluid that may flow though the flow path.

Further, in an arrangement, the valves 31 control the flow of hydraulic fluid from the passage 26 (of the rod 14) into respective annuluses 18; in this particular arrangement, controlling the hydraulic fluid flow from the passage 26 into respective annuluses 18 permits controlling any recoil of the compensated elevator link 10 after loss of tensional forces being applied to the elevator link 10.

As mentioned before, the hydraulic fluid may enter the passage 26 of the rod 14; in the particular arrangement shown in FIGS. 1*a* to 1*d*, this occurs when the compensated elevator link 10 (via a tensional force) is extended from the contracted condition (shown in FIG. 1*c*) to the extended condition (shown in FIG. 1*a*). By the hydraulic fluid entering the passage 26 of the rod 14, the hydraulic fluid compresses the (compressible) fluid contained in the passage 26 of the rod 14. In this manner, as the compressible fluid is compressed due to the entrance of the hydraulic fluid into the passage 26, a compressible fluid spring is defined within the passage 26 for applying a pressure to the hydraulic fluid permitting the compensated elevator link 10 to return to the contracted condition after the tensioning force is no longer applied to the compensated elevator link 10.

Furthermore, the particular arrangement of the compensated elevator link 10 shown comprises means for containment of the compressible fluid stored in the passage 26 of the rod 14 within a particular location of the passage 26. In this manner, it is ensured that no compressible fluid exits the passage 26 of the rod 14; also, the means for containment of the compressible fluid impedes direct contact between the hydraulic fluid and the compressible fluid during extension of the compensated elevator link 10.

In the particular arrangement shown in FIGS. 1*a* to 1*d*, the means for containment of the compressible fluid comprises a plurality of containment pistons 30 (containment pistons 30*a*, 30*b* shown in FIG. 1*c*) arranged in a spaced apart relationship with respect to each other thereby defining a space 33 within the passage 26 of the rod 14.

The containment pistons 30 are adapted to define a seal between the side walls (abutting the inner walls of the rod 14) of the containment pistons 30 and the inner walls of the rod 14; in this manner, any compressible fluid located between the containment pistons 30 is hindered from leaking through the containment pistons 30 and so as to flow to areas located outside the space 32 defined between the two containment pistons 30; and vice versa, any hydraulic fluid that enters the passage 26 of the rod 14 is hindered from leaking through the containment pistons 30 and flowing into the space 32 defined between two containment pistons 30.

Furthermore, the containment pistons 30 are adapted to slide within the passage 26 of the rod 14. The fact that the containment pistons 30 may slide within rod 14, permits, for example, reducing the distance between the containment pistons 30 by entry of hydraulic fluid into the passage of the rod 14. As hydraulic fluid enters the passage 26 pressure is applied to the containment pistons 30 reducing distance between the containment pistons 30 which results in compressing the compressible fluid located between the containment pistons 30.

Moreover, in the particular arrangement shown in FIGS. 1*a* to 1*c*, the hydraulic cylinder 12 are fluidly connected to a passage 26 of the rod 14; in this manner, the pressure applied to the hydraulic fluids of the first 12*a* and the second 12*b* hydraulic cylinders is the same.

As shown in, for example, FIG. 1*a*, the rod 14 comprises, at the centre location of the rod 14, an orifice plate 32 comprising an orifice 31 permitting fluid communication between the sections of the passage 26 that traverse the outer sections 16*a* and 16*b* of the rod 14. Due to the fluid communication provided by the orifice 31 the pressure of the compressible fluid is the same along the passage 26.

In an alternative arrangement, the rod 14 may be adapted to divide the passage 26 of the rod 14 into two separate sub-passages; this may be done via a blanking plate adapted to close the orifice 31 of the orifice plate 32. Dividing the passage 26 into two non-communicated passages will result in the pressure applied to the hydraulic fluids of the first 12*a* and the second 12*b* hydraulic cylinders 12 may differ with respect to each other depending on how the hydraulic cylinders have been pressurised.

Furthermore, the particular arrangement of elevator link 10 shown in FIGS. 1*a* to 1*d* comprises the first and second hydraulic cylinders 12*a* and 12*b* having diameters $d_a$ and $d_b$ that differ with respect to each other. In particular, the housing 13*a* of the first hydraulic cylinder 12*a* has a smaller diameter $d_a$ than the diameter $d_b$ of the housing 13*b* of the second hydraulic cylinder 12*b*.

The fact that the diameters $d_a$ and $d_b$ differ with respect to each other results in that the response (to tensional forces) of each of the hydraulic cylinders 12*a* and 12*b* differ with respect to each other when tensional forces are being applied to the hydraulic cylinders 12 and 12*b*.

In the particular arrangement shown in FIGS. 1 and 2 of the compensated elevator link 10 wherein the orifice 31 is open and the diameter $d_a$ of the first hydraulic cylinder 12*a* is smaller than the diameter $d_b$ of the second hydraulic cylinder 12*a*, the compensated elevator link 10 is configured such that: (1) the second hydraulic cylinder 12*b* is pressurised with sufficient pneumatic pressure to prevent the second hydraulic cylinders 12*b* from extending until a particular threshold pressure is reached due to a particular tensional force that is being applied to the compensated elevator link 10 due to an over-tension in the workstring 46 to which the compensated elevator link 10 is operatively attached; and (2) the first hydraulic cylinder 12*a* is pressurised with a particular pneumatic pressure that results in the first hydraulic cylinder 12*a* retracting when a particular threshold pressure is reached due to a particular tensional force that is being applied to the compensated elevator link 10 due to an under-tension in the workstring 46 to which the compensated elevator link 10 is operatively attached. The particular response of the compensator elevator link 10 shown in FIG. 1 when tensional forces are applied to the compensator link is depicted in FIG. 2 and FIG. 9.

Variations in the diameters $d_a$ and $d_b$ of the hydraulic cylinders 12*a* and 12*b* and either closing or opening the orifice plate 32 permits manufacturing different types of compensated elevator links 10 that have different responses with respect to each other during operation of the different types or embodiments of compensated elevator links 10.

Furthermore, in accordance with a particular arrangement of the present invention, each of the hydraulic cylinders 12 comprises the cylinder housing 13 closed on the outer ends of the compensated elevator link 10 by end caps 15. The caps 15 are bolted to the cylinder housing 13 including appropriate sealing means to define hermetic junctures between the bolts and the ends of the cylinder housing 13 of each hydraulic cylinder 12 that are capable of withstanding high pressure and capable of providing an air and fluid tight connection. In accordance with other arrangements, any type of connections means may be used.

In an arrangement, the outer ends of the cylinder housings 13 comprise access fill ports.

It is particular advantageous that the caps 15 are attached via bolts because it permits removal of the caps 15 for maintenance and inspection.

Referring now to FIG. 2.

Figures 2A, 2B, 2C, 2D, 2E:
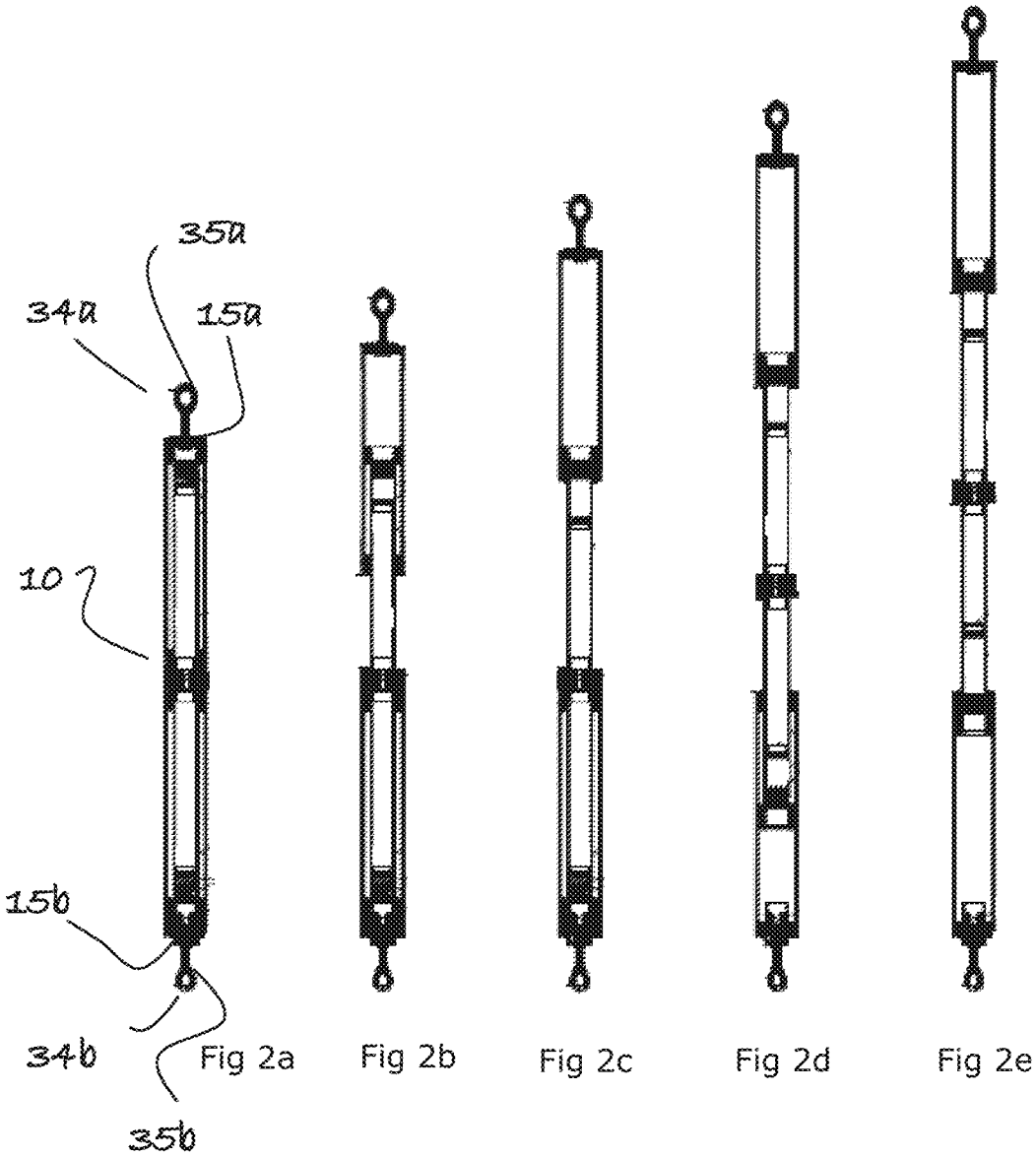
FIGS. 2*a*, 2*b*, 2*c*, 2*d* and 2*e* show the compensated elevator link shown in FIG. 1*c* undergoing movement from the contracted condition to the extended condition.

FIG. 2 show several views of a particular arrangement of a compensated elevator link 10 in accordance with the present embodiment of invention. As shown in FIGS. 2*a* to 2*d*, the compensated elevator link 10 comprises a plurality of bail eyes 34 (bail eyes 34*a*, 34*b* shown) attached to respective caps 15 (caps 15*a*, 15*b* shown) of each hydraulic cylinder 12*a*, 12*b*. The bail eyes 34 permit, for example, attachment of the compensated elevator link 10 to drilling components of drilling rigs 36 when the compensated elevator link 10 is used as a back-up heave compensation unit 50 for use in drilling rigs 36 that will be activated by itself if the primary rig compensation unit 48 fails.

In an arrangement, bail eyes 34 are configured to be compatible with other drilling components and are adapted to interface with other production components.

In accordance with a particular arrangement of the present invention, the bail eyes 34 are connected to respective forged bail ends 35 (forged bail ends 35*a*, 35*b* shown) having a threaded end to be mechanically connected to the caps 15. Each cap 15 comprises an opening having an inner thread for receiving the threaded end of the respective forged bail 35. Alternatively, the connection between the caps 15 and the bail ends 35 is done through a shear pin style trough connection.

As will be described below, it is particularly advantageous the use of forged bail ends 35 as depicted in FIG. 2 because it permits easy handling of the compensated elevator links 10 and, as will be described below with reference to the method of operation of a heave compensation unit 50 (see FIG. 4), the compensated elevator link 10 may be easily mounted on spreader beams 52 and dismounted therefrom. In an arrangement, the forged bail ends 35 are forged from a single piece of metal.

Figure 4:
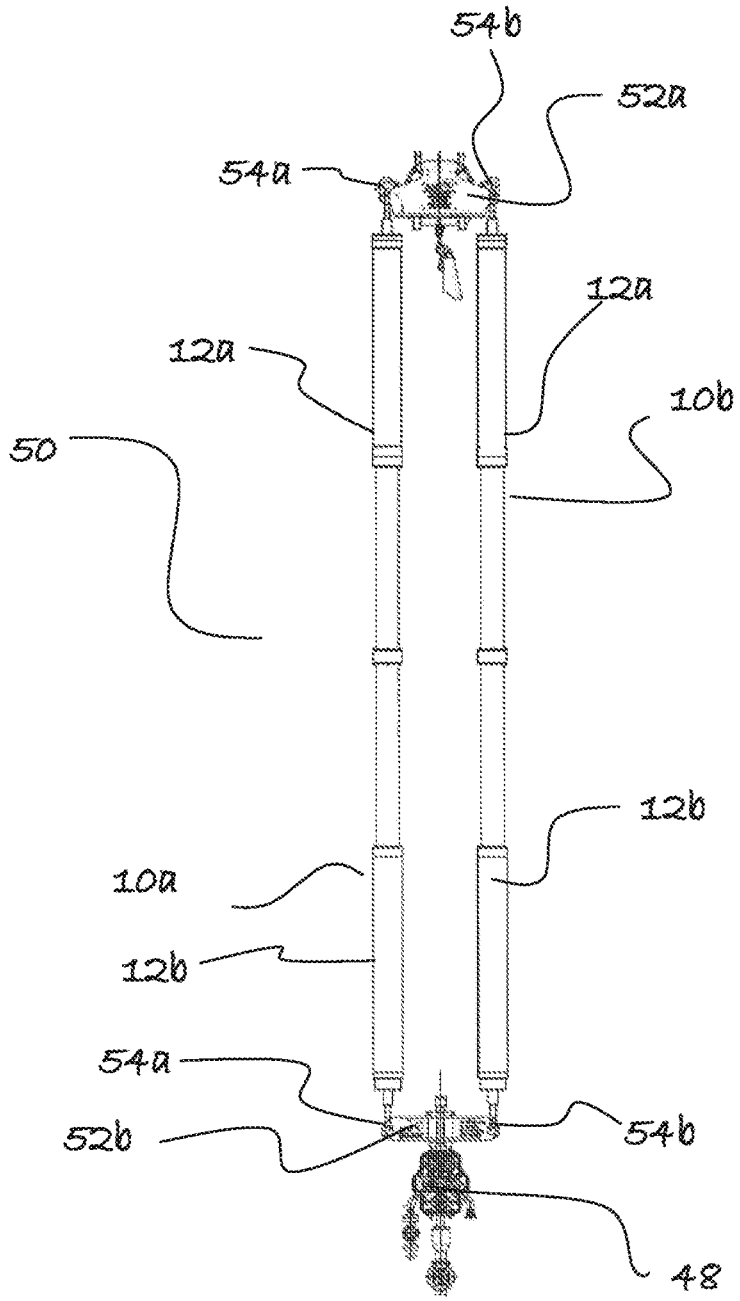
FIG. 4 shows a front (or elevation) view of the compensation unit shown in FIG. 3.

In a particular arrangement, each of the compensated elevator links 10 may comprise ports for fluidly connecting a plurality of compensated elevator links 10 to each other so as to define a compensation unit 50 shown in FIG. 4. For example, rod 14 of each compensated elevator links 10 may comprise a port for the connection of tubing so as to, for example, fluidly connect the passages 26 (defining accumulators containing the compressible fluid) of the rods 14. By sharing the accumulators contained in rods 14 the compensated elevator links 10 will respond to tension in unison.

In an alternative arrangement, the compensated elevator links 10 of, for example, the compensation unit 50 shown in FIG. 4, may not be joined together as described in the previous paragraph; but instead the accumulator of the rods 14 of all the compensated elevator links 10 have matched pressures and thus all of the compensated elevator links 10 will respond to tension in unison.

Further, each compensated elevator link 10 may comprise one or more sensors for measurement of temperature and pressure of the hydraulic and compressible fluids contained in the spaces 22 of the hydraulic cylinders 12 and the passage 26 of the rod 14. In an arrangement, the sensors comprise wireless sensors.

Furthermore, the hydraulic cylinders 12 may comprise locking means for impeding extension of the hydraulic cylinders 12.

In a particular arrangement, the second hydraulic cylinder 12*b* comprises locking means for impeding extension of the second hydraulic cylinder 12*b*. The inclusion of locking means is particularly advantageous because it permits: (1) locking of the second hydraulic cylinder 12*b* (impeding extension of the second hydraulic cylinder 12*b*) during installation of the compensation unit 50 and lifting of the compensation unit 50 as will be described below with reference to FIGS. 5 to 8; and (2) each compensated elevator link 10 may be operated in two different conditions—one condition wherein only the first hydraulic cylinder is operative (being capable of being extended) while having the second hydraulic cylinder 12*b* locked, and a second condition wherein both hydraulic cylinders 12*a* and 12*b* are operative (being capable of being extended).

Moreover, particular arrangements of the hydraulic cylinders 12 may comprise means for impeding the piston heads 20 from impacting with relative large force the ends of the housing 13 incorporating the caps 15 of the hydraulic cylinders 12.

FIG. 2 illustrates the compensated elevator link 10 as it is being displaced from the contracted condition to the extended condition.

In particular, in FIG. 2*a* the compensated elevator link 10 is located in the contracted condition. As mentioned earlier, the compensated elevator link 10 comprises a compressible fluid reservoir inside the rod 14 that acts like a spring applying pressure to the hydraulic fluid contained inside the hydraulic cylinders 12.

In particular arrangements, the compensated elevator link 10 is adjusted such that when either no tensional force or a tensional force of a particular magnitude (see FIG. 9—point (a)) is applied to the ends of the compensated elevator link 10, the compensated elevator link 10 is kept in the contracted condition as shown in FIG. 2*a*.

As tensional forces are applied to the compensated elevator link 10, the compensated elevator link 10 will start expanding as is shown in FIGS. 2*b* to 2*e*.

FIG. 2*b* shows the compensated elevator link 10 when a tensional force of a particular magnitude ((see FIG. 9—point (b)) is applied to the compensated elevator link 10; at this particular magnitude of tensional force the result in extension (also referred to as stroke) of the first hydraulic cylinder 12*a* while the second hydraulic cylinder 12 is kept in the contracted condition.

FIG. 2*c* shows the compensated elevator link 10 having the first hydraulic cylinder 12*a* fully extended with the second hydraulic cylinder 12*b* being kept in the contracted condition as a tensional force of a particular magnitude (see FIG. 9—point (c)) is applied to the compensated elevator link 10.

In the condition shown in FIG. 2*c*, the compensated elevator link 10 is suitable for acting as a back-up compensator for a drilling rig 36 if the primary rig compensation unit 49 fails.

In the circumstances where the compensated elevator link 10 is installed to a particular drilling 36 as a backup compensator, the compensated elevator link 10 is kept in the static condition (by static condition is meant no retraction or expansion of the hydraulic cylinders 12) during normal drilling rig operations (this is when the primary rig compensation unit 49 is functioning properly). The compensated elevator link 10 will itself activate upon failure of the primary rig compensation unit 49 of the drilling rig 36. Once activated, the compensated elevator link 10 may compensate for the drilling rig 36 movement.

In a particular arrangement of the compensated elevator link 10, the second hydraulic cylinder 12 may be locked to impede expansion of the second hydraulic cylinder 12. In the locked condition, a much larger over-pull load can be achieved (the dotted line 62 in FIG. 9 shows this particular condition). However, typically, during use of the compensated elevator link 10 as back-up compensator the second hydraulic cylinder 12 will not be locked.

Referring now to FIG. 2*d*—in this condition, the second hydraulic cylinder 12*b* is being applied a tensional force of a particular magnitude (see FIG. 9—point (d)) resulting in progressive extension of the second hydraulic cylinder 12*b* and the first hydraulic cylinder 12*a* is kept in the extended condition as the tensional force increases as represented by the sloped lines in the graph depicted in FIG. 9; during extension of the second hydraulic cylinder 12*b*.

FIG. 2*e* shows the compensated elevator link 10 with both hydraulic cylinders 12 fully extended due to the fact that a tensional force of a particular magnitude (see FIG. 9—point (d)) is being applied to the compensated elevator link 10.

Furthermore, the particular arrangement of the elevator link 10 shown in FIGS. 1 and 2 is configured such that for tensional forces having magnitude that fall within a particular range (see FIG. 9—point (c) to point (c')) the elevator link will be kept in the static condition. This particular range is referred to as the "load step".

Referring now to FIGS. 3 to 8.

As mentioned before, a particular application of the compensated elevator link 10 is to act as a back-up compensator in a semi-submersible drilling rig 36 for activation in case its primary rig compensation unit 49 fails.

Figure 3:
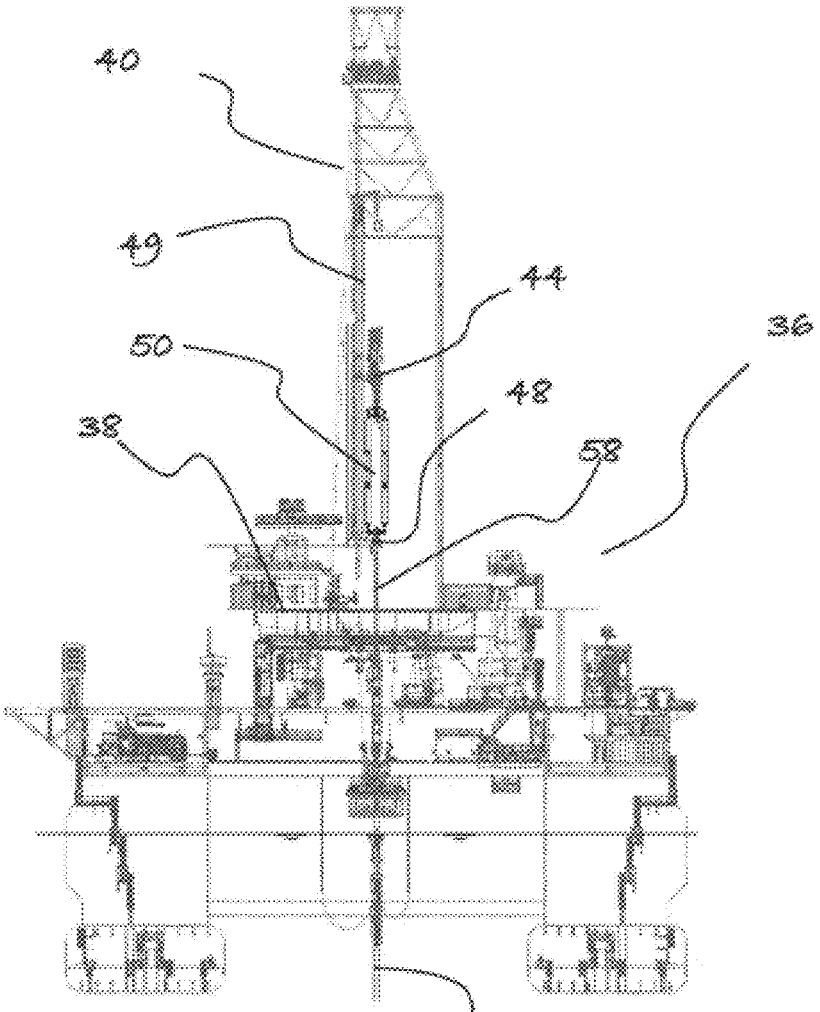
FIG. 3 shows a semi-submersible drilling rig comprising a particular arrangement of a compensation unit having a plurality of compensated elevator links arranged in accordance with the embodiment shown in FIGS. 1*a* to 1*c* operatively connected to the main hoist, and the surface flow head connected to the workstring.

FIG. 3 shows the semi-submersible drill rig 36 comprising a drill floor 38 on which a derrick 40 has been erected. The derrick 40 comprises the main hoist. In particular, the main hoist is located at the upper portion of the derrick 40 for selectively lowering and raising the workstring 46. The drilling rig 36 comprises the primary rig compensation unit 49 to maintain work tension on the workstring 46 during movement of the drilling rig 36 during heave and tide motion. As mentioned before, on occasions, primary rig compensation unit 49 may fail requiring activation of a back-up heave compensator to avoid damage of, for example, the workstring 46 such as by compensating for the heave and tide motion to which the drilling rig 36 is continuously subjected to.

As shown in FIG. 3, the compensated elevator link 10 arranged in accordance with the present embodiment of the invention described herein may be operatively connected to the main hoist for acting as a back-up heave compensator that may activate if the primary rig compensation unit 49 fails—in this case the compensated elevator link 10 is acting as an inline compensator.

In other arrangements, a plurality of compensated elevator links 10 may be assembled together for defining a back-up heave compensator 50 as is shown in FIGS. 3 and 4. FIG. 3 shows the back-up heave compensator 50 operatively connected to the top drive 44 and to the workstring 46.

FIG. 4 shows a particular arrangement of the back-up heave compensator 50. As will be described with reference to the method of operation of the back-up heave compensator 50, the back-up heave compensator 50 is adapted to compensate for excessive tensional forces that may applied to the workstring 46 during failure of the primary rig compensation unit 49 providing over-tension protection to the workstring 46.

The back-up heave compensator 50 comprises first and second compensated elevator links 10*a* and 10*b*. The upper ends of the compensated elevator links 10 are attached to an upper spreader beam 52*a* and the lower ends of the compensated elevator links 10 are attached to a lower spreader beam 52*b*. For this the upper and lower spreader beams 52*a*, 52*b* comprises means for attaching to respective bail eyes 34 of respective compensated elevator links 10.

In particular, each means for attaching the bail eyes 34 comprises a lug 54 configured for receiving the eye of the bail eye 34. Each lug 54 comprises a gate to impede exit of the bail eye 34 from the lug 54.

Further, each of the spreader beams 54 comprises a pair of lugs 54 spaced apart with respect to each other so that the compensated elevator links 10*a* and 10*b* are arranged in a spaced apart relationship with respect to each other when the bail eyes 34 of the compensated elevator links 10 are, respectively, attached to the lugs 54 of respective upper and lower spreader beams 52.

Furthermore, as shown in FIG. 3, the back-up heave compensator 50 is attached between the top drive 44 and the workstring 46; for this, the upper and lower spreader beams 52 are, respectively, adapted to be releasably attached to the top drive 44 and the workstring 46 by attachment means such as clevises or shackles configured to that end.

In accordance with a particular arrangement of the invention, the compensation unit 50 comprises a pair of the compensated elevator links 10 in accordance with the present embodiment of the invention.

In accordance with this particular arrangement of compensation unit 50 each compensated elevator link 10 is configured such that: (1) the second hydraulic cylinders 12*b* are pressurised with sufficient pneumatic pressure to prevent the second hydraulic cylinders 12*b* from extending until a particular threshold pressure is reached due to a particular tensional force that is being applied to the compensated elevator link 10 due to an over-tension in the workstring 46 to which the compensated elevator link 10 is operatively attached; and (2) the first hydraulic cylinders 12*a* are pressurised with a particular pneumatic pressure that results in the first hydraulic cylinders 12 retracting when a particular threshold pressure is reached due to a particular tensional force that is being applied to the compensated elevator link 10 due to an under-tension in the workstring 46 to which the compensated elevator link 10 is operatively attached.

Pressurisation of the hydraulic cylinders 12 to have a particular pressure (for example, a sufficient pneumatic pressure to prevent the hydraulic cylinders 12 from extending or a particular pneumatic pressure that results in the hydraulic cylinders 12 retracting) may be conducted by, for example, (1) opening or closing the orifice 31 of the orifice plate 32, (2) providing the hydraulic cylinders 12 with housings having particular diameters, (3) filling the hydraulic cylinders 12 or the rod 14 with a particular type of working fluids (non-compressible or compressible fluids) at a particular pressure.

Figure 5:
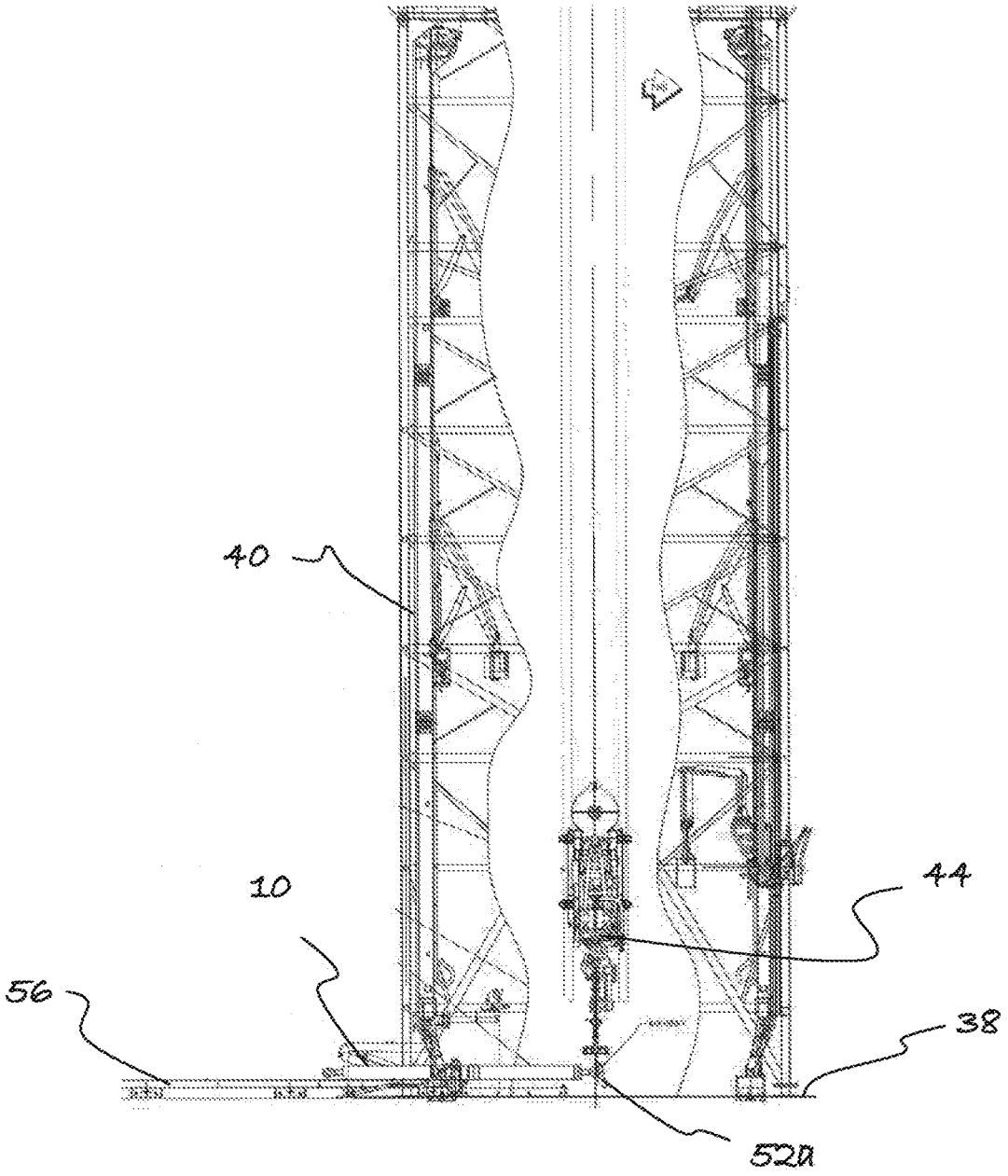
FIGS. 5, 6, 7 and 8 show the process for installing the compensation unit shown in FIG. 4 to the derrick of the semi-submersible drilling rig shown in FIG. 3.
Figure 6:
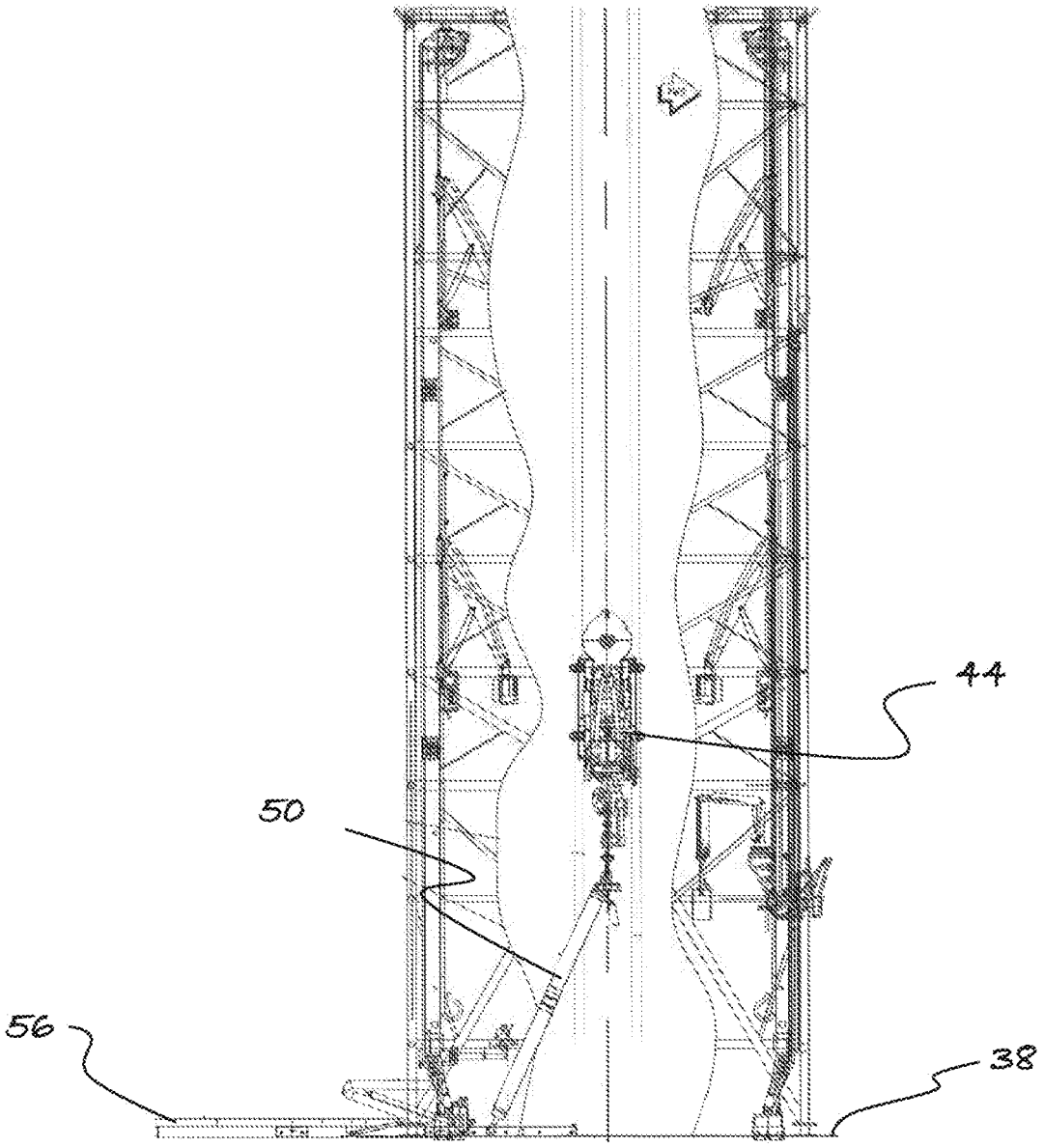
Figure 7:
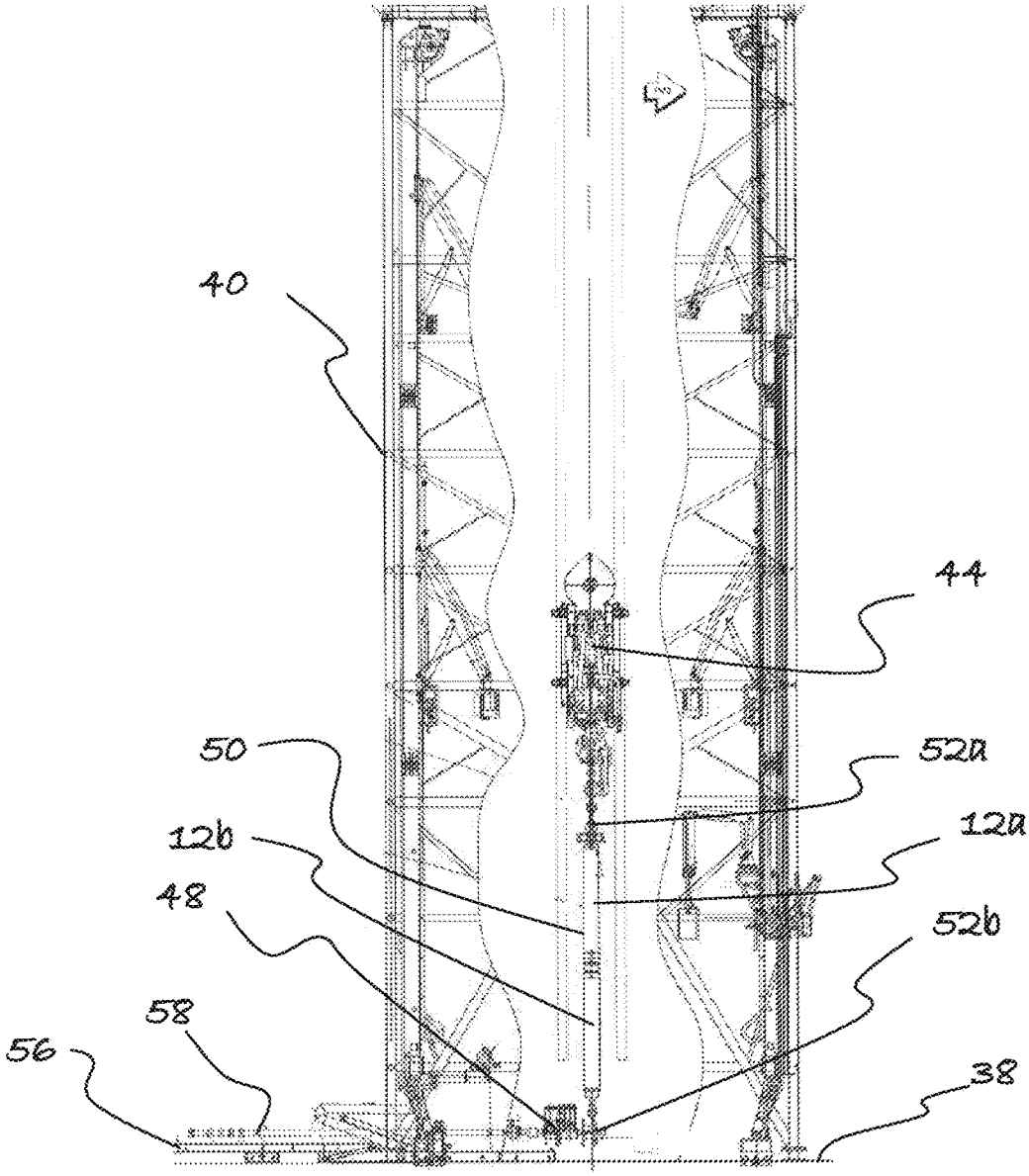

Referring now to FIGS. 5 to 7. FIGS. 5 to 7 show the process of installation of the back-up heave compensator unit 50 to the derrick 40 of the semi-submersible drilling rig 36 shown in FIG. 3.

As shown in FIG. 5, the compensated elevator links 10 are arranged in a spaced apart relationship with respect to each other and lying horizontally on a riser skate 56 mounted on the drill floor 38; the upper spreader beam 52*a* is attached to the main hoist including the top drive 44; and subsequently, the bail eyes 34*a* of each compensated elevator link 10 is attached to the upper spreader beam 52*a*.

Further, after attaching the upper portion of the compensated elevator links 10 to the upper spreader beam 52*a*, the compensation unit 50 is lifted as shown in FIG. 6 in order to be used for lifting of the workstring 46 and completion thereof.

Prior to lifting of the compensation unit 50, the second hydraulic cylinders 12*b* (the lower units) are locked; in this manner, the second hydraulic cylinders 12*b* are impeded from extending during lifting of the compensation unit 50. This particular arrangement prevents the lower portion of the compensation unit 50 from extending.

Further, lifting of the compensation unit 50 is stopped once the compensation unit is in the vertical condition as shown in FIG. 7. In the vertical condition, the lower spreader beam 52*b* is attached to the lower portion of the compensation unit 50 and the surface flow head 48 having a landing joint 58 for attachment to the workstring 46. At this stage, the riser skate 56 is located in the contracted condition and the compensation unit 50 is lifted to locate the landing joint 58 in the vertical condition.

Figure 8:
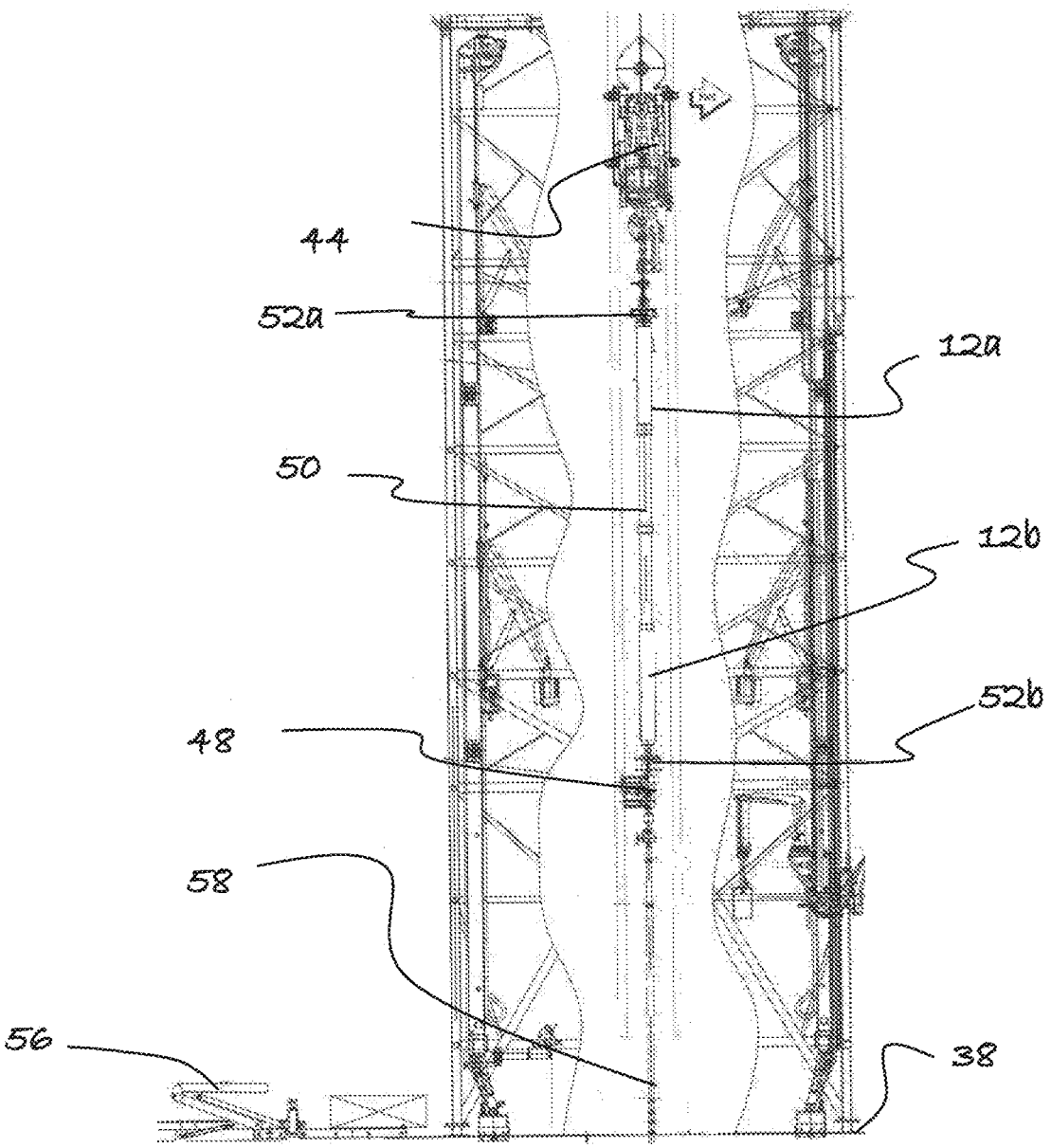

The second hydraulic cylinders 12*b* may be unlocked now so as to permit full extension of the compensation unit 50 as is shown in FIG. 8 for testing purposes as will be explained below. Alternatively, the second hydraulic cylinders 12*b* may be kept locked to impede full extension of the compensation unit 50.

FIG. 8 shows the compensation unit 50 rigged up and ready for connection to the workstring 46.

In operation, during normal drilling rig operations, the first hydraulic cylinders 12*a* of the compensation unit 50 are fully stroked-out and second hydraulic cylinders 12*b* are fully stroked-in as shown in FIG. 2*c*; in this condition, the compensation unit 50 maintains the static condition (i.e. no substantial retraction of expansion of the hydraulic cylinders 12).

The first hydraulic cylinders 12*a* (the upper hydraulic cylinder) provides protection for an under-tension case. This means that if the first hydraulic cylinders 12*a* were to begin to retract, tension would be maintained within the workstring 46 to ensure that the workstring 46 does not go into compression. At full retraction of the first hydraulic cylinders 12*a* nominal tension would still be maintained within the workstring 46.

The second hydraulic cylinders 12*b* of the units during normal operations are fully stroked in (as shown in FIG. 2*c*) and provide protection for an over-tension condition of the workstring because tension in the workstring 46 will be maintained at a safe level due to the second hydraulic cylinders 12*b* extending due to, for example, heave.

Further, during normal drilling rig operations with the primary rig compensation unit 49 engaged (and fully operative) the compensation unit 50 in accordance with the present embodiment of the invention will be kept in the static condition (i.e. no substantial retraction of extension of the hydraulic cylinders 12) such that, for example, the first hydraulic cylinders 12*a* are in the fully extended condition and the second hydraulic cylinders 12*b* are in the retracted condition. That this is so can be appreciated from the tension vs. stroke curve shown in FIG. 9. As can be appreciated in FIG. 9 depicting the load step 66, the load step is set to allow for variations of tension within the workstring 46 but ensuring that the compensation unit 50, in normal operations where the primary rig compensation unit 50 is functioning properly, does not stroke so as to stay in the static condition.

In the event that the primary rig compensation unit 49 fails, the compensation unit 50 instantly activates to compensate for drilling rig movement; this is important to occur because at the instance where the primary rig compensation unit 49 fails, tension in the workstring 46 will begin to change due to lack of compensation from the failed primary rig compensation unit 49; and, changes in tension of the workstring 46 may fracture or break the workstring 46.

At the instance where the tensional forces fall outside load step 66, the first 12*a* and/or second 12*b* hydraulic cylinders will begin stroking—either extending or contracting—depending on relative rig motion.

The compensation unit 50 due to the stroking motion will provide compensation for a period of time sufficient to allow the drilling rig crew to either fix the primary rig compensation unit 49 or unlatch workstring 46 from the seabed.

Referring now to FIG. 9 which shows the tension vs stroke of a pair of compensated elevator link defining the compensation unit 50; it was mentioned before that the compensated elevator link may act in a second condition in which the second hydraulic cylinder is not operative (not being able to be extended) in this condition the over-pull load applied to the compensated elevator links 10 is represented by the dotted line 62.

Further, the line 60 shows the normal tension due to drilling rig heave if the back-up compensation unit 50 is activated. Dotted line 62 shows the tension for extreme overload mainly due to accidental load cases such when failure of the active heave compensation unit coincides with extreme heave conditions outside the range of normal operating conditions of the drilling rig 36.

Figure 10:
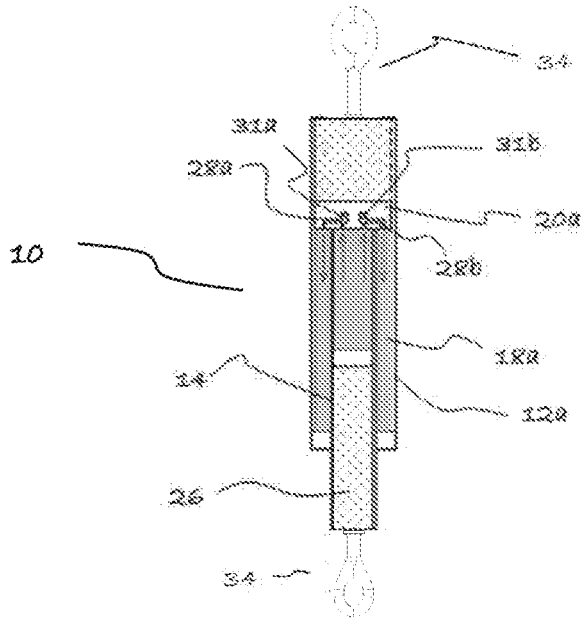
FIG. 10 shows a cross-sectional view of a particular arrangement of a compensated elevator link arranged in accordance with an alternative embodiment of the invention (shown in an extended condition)
Figure 11:
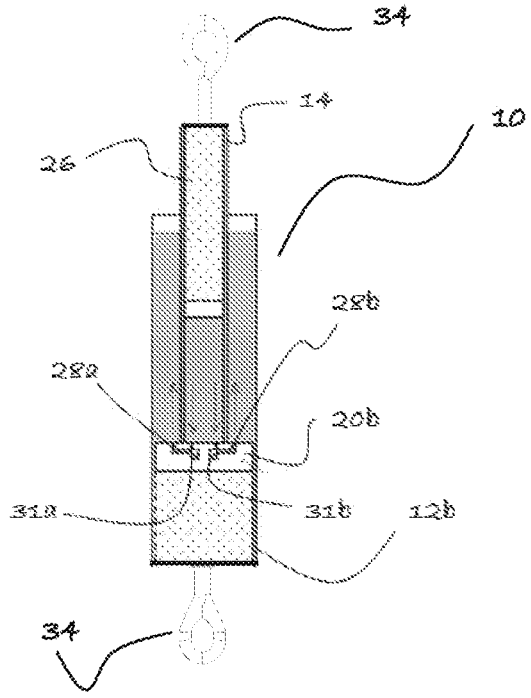
FIG. 11 shows a cross-sectional view of a particular arrangement of a compensated elevator link arranged in accordance with another alternative embodiment of the invention (shown in an extended condition).

Referring now to FIGS. 10 and 11

FIGS. 10 and 11 show particular arrangements of elevator links 10 in accordance with alternative embodiments of the present invention.

In particular, FIGS. 10 and 11 show a compensated elevator link 10 comprising the first hydraulic cylinder 12*a* and the rod 14.

As mentioned before in relation with the compensated elevator link 10 shown in FIG. 1, the cylinder housing 13 of the first hydraulic cylinder 12*a* slideably attaches to the rod 14 permitting the compensated elevator link 10 to be selectively displaced between an extended condition and a contracted condition and the rod 14 comprises a piston 30 defining two spaces 22*a* and 22*b* within the housing 13. The space 22*b* defined in each annulus 18 of the hydraulic cylinders 12 is adapted to receive a hydraulic fluid (such as oil) and the space 22*a* may comprise a vacuum or may include a compressible fluid (such as nitrogen); in case the space 22*a* includes a compressible fluid a low pressure cushion of compressible fluid is defined within the space 22*a*. The rod 14 comprises the passage 26 for containment of the compressible fluid (such as nitrogen) and the hydraulic fluid (such as oil).

These particular arrangements of elevator links 10 may be used for the applications mentioned earlier in connection with the compensated elevator link 10 shown in FIG. 1; for example, these particular elevator links maybe used as inline compensators for installation between the derrick (40) and the workstring (46).

As was described before with respect to the compensator link 10 shown in FIGS. 1 and 2, the compensator elevator links 10 shown in FIGS. 10 and 11 may be configured so as to act as tension compensators, compression compensators, or tension and compression compensators depending of the particular application of the compensator link 10.

In one arrangement, the hydraulic cylinder is pressurised with a particular pneumatic pressure that results in the hydraulic cylinder retracting when a particular threshold pressure is reached due to a particular tensional force that is being applied to the compensated elevator link. In this arrangement, the hydraulic cylinder of the compensated elevator link is retracting due to an under-tension in the workstring to which the compensated elevator link is operatively attached.

In an alternative arrangement, the hydraulic cylinder is pressurised with sufficient pneumatic pressure to prevent the second hydraulic cylinders from extending until a particular threshold pressure is reached due to a particular tensional force that is being applied to the compensated elevator link. In this alternative arrangement, hydraulic cylinder of the compensated elevator link is extending due to an over-tension in the workstring.

Modifications and variations as would be apparent to a skilled addressee are deemed to be within the scope of the present invention.

Further, it should be appreciated that the scope of the invention is not limited to the scope of the embodiments disclosed.

The compensation unit 50 has been described as having a pair of compensated elevator links 10; however, in accordance with other embodiments of the invention, the compensation unit 50 may incorporate a single compensated elevator link 10 or more than two compensated elevator links 10.

In the particular arrangement including a single compensated elevator link 10, the compensation unit 50 may be used as an inline compensator unit located between the hoist assembly and the workstring 46.

Further, the compensation unit 50 has been described for use as a back-up compensation unit 50 that is activated in the event when the primary rig compensation unit 49 fails; however, the back-up compensation unit 50 as described with reference to all of the embodiments herein described may also be used as primary rig compensation unit 49.

In all embodiments described, arrangements for tempering, softening, or cushioning movement of the piston rod (14) end (relative to respect end surfaces) within a respective housing could be employed. Inclusion of such arrangements may serve to reduce, for example, wear and tear of the equipment during use by mitigating against hard wearing operation (ie. Hard impacts of the piston head at its corresponding end surface). For example, such arrangements may include one or more fluid galleries configured for controlling the direction and/or rate of fluid flowing therethrough so as to vary hydraulic resistance. The skilled reader would appreciate that many arrangements exist for varying the hydraulic resistance in such systems can be devised in order to achieve a desired response profile.

Throughout this specification, unless the context requires otherwise, the word "comprise" or variations such as "comprises" or "comprising", will be understood to imply the inclusion of a stated integer or group of integers but not the exclusion of any other integer or group of integers.

What is claimed is:

1. An elevator link arranged for use in providing a compensatory response to a load applied thereto, the elevator link comprising:

a first hydraulic cylinder and a second hydraulic cylinder configured operable with a piston rod by way of respective non-compressible fluids, the piston rod having an internal chamber for accommodating a compressible fluid and at least a portion of the respective non-compressible fluids, the first hydraulic cylinder and the second hydraulic cylinder arranged in operable association with the piston rod such that the non-compressible and compressible fluids are cooperable with each other so as to allow the elevator link to be operable toward and/or from one of an extended condition and a retracted condition in response to the load, wherein each cylinder comprises a housing and, wherein opposite free ends of the piston rod are slideably associated with a respective housing.

2. An elevator link according to claim 1, wherein opposite free ends of the piston rod are slideably associated with a respective cylinder housing.

3. An elevator link according to claim 1, wherein where the elevator link is arranged operable for 'in-line' use in a drilling operation and configured operable for providing one or more of the following responses: tension compensation, compression compensation, and tension and compression compensation.

4. A method of providing back-up compensation to a drilling rig mounted on a vessel or semi-submersible rig comprising a primary rig compensation unit, and a derrick and a workstring operatively attached to a main hoist attached to the derrick in instances where the primary rig compensation unit fails, the method comprising the steps of:

connecting one or more elevator links arranged according to claim 1 between the main hoist and the workstring;

pressurising a first hydraulic cylinder with a particular pneumatic pressure that results in the first hydraulic cylinder retracting when a particular threshold pressure is reached due to a particular tensional force being applied to the or each elevator link; and pressurising a second hydraulic cylinder with sufficient pneumatic pressure to prevent the second hydraulic cylinder from extending until a particular threshold pressure is reached due to a particular tensional force being applied to the or each elevator link.

5. A compensated elevator link comprising a plurality of cylinder housings and a rod having a plurality of ends, each end comprising a piston head adapted to be slideably received within one of the cylinder housings for defining a first hydraulic cylinder and a second hydraulic cylinders, each of the first hydraulic cylinder and second hydraulic cylinder is having at least one annulus for receiving a non-compressible fluid and the rod comprising a passage for receiving a compressible fluid; wherein each piston head comprises at least one passage to allow selective displacement of the non-compressible fluid between the annulus of the cylinder housing and the passage within the rod during selective displacement of the hydraulic cylinders between a contracted condition to an extended condition for either compression or expansion of the compressible fluid by the non-compressible fluid.

6. A compensated elevator link according to claim 5, wherein the first hydraulic cylinder is pressurised with a particular pneumatic pressure that results in the first hydraulic cylinder retracting when a particular threshold pressure is reached due to a particular tensional force that is being applied to the compensated elevator link.

7. A compensated elevator link according to claim 6, wherein, for the case where said particular tensional force is being applied by way of a workstring of a drilling rig, the particular threshold pressure is reached due to an under-tension in the workstring.

8. A compensated elevator link according to claim 5, wherein the second hydraulic cylinder is pressurised with sufficient pneumatic pressure to prevent the second hydraulic cylinder from extending until a particular threshold pressure is reached due to a particular tensional force that is being applied to the compensated elevator link.

9. A compensated elevator link according to claim 8, wherein, for the case where said particular tensional force is being applied by way of a workstring of a drilling rig, the particular threshold pressure is reached due to an over-tension in the workstring.

10. A compensated elevator link according to claim 5, wherein each piston head when contained in a cylinder housing defines a plurality of spaces in the cylinder housing, wherein a first space is defined between the piston head and the end of the cylinder housing, and wherein the first space comprises a vacuum or a compressible fluid at low pressure.

11. A compensated elevator link according to claim 10, wherein a second space is defined between an entry point of the cylinder housing and the piston head, and wherein the second space defines the annulus including the non-compressible fluid.

12. A compensated elevator link according to claim 5, wherein the annulus of each hydraulic cylinder is defined between the inner walls of the cylinder housing and the outer walls of the rod.

13. A compensated elevator link according to claim 5, wherein each piston head comprises a plurality of fluid paths fluidly connecting the annulus of the respective hydraulic cylinder, and the passage of the rod.

14. A compensated elevator link according to claim 13, wherein each fluid path comprises a valve adapted to control fluid flow, and wherein the valves are adapted to control the flow of non-compressible fluid from the passage of the rod into the annulus, thereby, seeking to, at least in part, control the non-compressible fluid flow from the passage into the annulus permitting control of the recoil of the compensated elevator link after removal of the tensional forces.

15. A compensated elevator link according to claim 5, wherein the compressible fluid is operable, at least in part, for providing a compressible fluid spring within the passage of the rod for applying a pressure to the non-compressible fluid entering the rod permitting the compensated elevator link to return to the retracted condition after a tensional force is no longer applied to the compensated elevator link.

16. A compensated elevator link according to claim 5, wherein the first hydraulic cylinder and second hydraulic cylinders are fluidly connected to the passage of the rod such that the pressure applied to the non-compressible fluid of the first and second hydraulic cylinder is the same.

17. A compensated elevator link according to claim 5, wherein each cylinder housing comprises a first end and a second end, the first end being adapted for receiving a cap for closing of the first end, and the second end adapted to receive a respective piston head coupled to the piston rod.

18. A compensated elevator link according to claim 5, wherein the compensated elevator link is adapted to be fluidly connected to another compensated elevator link arranged in accordance with the compensated elevator link of claim 5.

19. A method of providing back-up compensation to a drilling rig mounted on a vessel or semi-submersible rig comprising a primary rig compensation unit, and a derrick and a workstring operatively attached to a main hoist attached to the derrick in instances where the primary rig compensation unit fails, the method comprising the steps of:

connecting one or more compensated elevator links arranged according to claim 5 between the main hoist and the workstring;

pressurising a first hydraulic cylinder with a particular pneumatic pressure that results in the first hydraulic cylinder retracting when a particular threshold pressure is reached due to a particular tensional force being applied to the or each compensated elevator link; and pressurising a second hydraulic cylinder with sufficient pneumatic pressure to prevent the second hydraulic cylinder from extending until a particular threshold pressure is reached due to a particular tensional force being applied to the or each compensated elevator link.

20. An elevator link arranged for use in providing a compensating response to a load applied between load points of the elevator link, the elevator link comprising:

a first hydraulic cylinder associated with one of the load points;

a second hydraulic cylinder associated with another of the load points; and a piston rod connecting a respective piston of each hydraulic cylinder;

wherein movement of each piston within the respective hydraulic cylinder is according to an amount of a respective non-compressible first working fluid in the respective hydraulic cylinder;

wherein the piston rod comprises an internal chamber for accommodating a compressible second working fluid and at least a portion of the respective non-compressible first working fluids, wherein the first and second working fluids cooperate to determine the amount of respective first working fluid in each respective hydraulic cylinder so as to allow the elevator link to extend or retract between the load points in response to the load.

* * * * *